US010352015B2

(12) United States Patent
Spencer

(10) Patent No.: US 10,352,015 B2
(45) Date of Patent: Jul. 16, 2019

(54) SHORING END SECTION ASSEMBLY AND METHOD OF USE

(71) Applicant: Safety Products Engineering Group, Inc., Commerce City, CO (US)

(72) Inventor: Scott Spencer, Springville, UT (US)

( * ) Notice: Subject to any disclaimer, the term of this patent is extended or adjusted under 35 U.S.C. 154(b) by 0 days.

(21) Appl. No.: 16/174,041

(22) Filed: Oct. 29, 2018

(65) Prior Publication Data

US 2019/0136479 A1 May 9, 2019

Related U.S. Application Data

(63) Continuation of application No. 15/808,884, filed on Nov. 9, 2017, now Pat. No. 10,145,078.

(51) Int. Cl.
*E02D 17/08* (2006.01)

(52) U.S. Cl.
CPC ..... *E02D 17/08* (2013.01); *E02D 17/083* (2013.01)

(58) Field of Classification Search
CPC ..... E02D 17/08; E02D 17/083
USPC ..... 405/282
See application file for complete search history.

(56) References Cited

U.S. PATENT DOCUMENTS

| | | | |
|---|---|---|---|
| 3,490,187 | A | 1/1970 | Stauffer |
| 4,033,138 | A | 7/1977 | Griswold |
| 4,056,938 | A | 11/1977 | Griswold |
| 4,139,324 | A | 2/1979 | Krings |
| 4,259,028 | A | 3/1981 | Cook |
| 4,453,863 | A | 6/1984 | Sutton |
| 5,277,522 | A | 1/1994 | Pertz |
| 5,741,091 | A | 4/1998 | St. George |

(Continued)

FOREIGN PATENT DOCUMENTS

| | | |
|---|---|---|
| DE | 3711408 | 10/1988 |
| FR | 2615218 | 11/1988 |
| GB | 2115453 | 9/1983 |

OTHER PUBLICATIONS

Dec. 29, 2017, Declaration of Scott Spencer regarding experimental use.

(Continued)

*Primary Examiner* — Frederick L Lagman
(74) *Attorney, Agent, or Firm* — Durham Jones & Pinegar; Sarah W. Matthews; Randall B. Bateman

(57) ABSTRACT

A shoring end section assembly is described which may allow increased strength, increased longevity, and ease of use. The end section assembly may be comprised of a through-wall tube that is substantially hollow, and a connection assembly comprised of one or more through-wall tubular coupling assemblies. Each through-wall tubular coupling assembly may be comprised of a hollow through-wall tubular coupling which extends through the through-wall tube, a spreader stop disposed inside the hollow through-wall tubular coupling, a through-wall collar disposed between the hollow through-wall tubular coupling and the through-wall tube, a tubular coupling pin washer plate, and a tubular coupling collar disposed around the proximal end of the tubular coupling. Each through-wall tubular coupling assembly may have a transverse rigidifying member extending between them, and a notched angle brace assembly may be attached to the lowest through-wall tubular coupling assembly.

15 Claims, 8 Drawing Sheets

(56) References Cited

U.S. PATENT DOCUMENTS

| | | | | |
|---|---|---|---|---|
| 6,443,665 | B1 | 9/2002 | Kundel, Sr. | |
| 7,056,068 | B2 | 6/2006 | Kadiu | |
| 7,611,308 | B1 | 11/2009 | Kundel, Sr. | |
| 7,837,413 | B1 | 11/2010 | Kundel, Sr. | |
| 8,845,238 | B1 | 9/2014 | Fontaine | |
| 9,441,341 | B1 | 9/2016 | Hames | |
| 10,145,078 | B1 * | 12/2018 | Spencer | E02D 17/08 |
| 2016/0108599 | A1 | 4/2016 | Spry | |

OTHER PUBLICATIONS

Photo of trench box by Efficiency Production with through wall collars and integral spreader collar post design, available at http://www.efficiencyproduction.com/ht6-steel-shields at least as early as Aug. 8, 2017.

Photo of trench box by GME with trapped through wall collar assemblies, available at https://gme-shields.com/steel- rench-shield-products/4-trench-shields/4m-trench-shields/ at least as early as Nov. 27, 2017.

Picture of through wall collars by Efficiency Production, available at https://assets1.bywebtrain.com/501470/thru_wall_collars_webthumb.jpg?r=1366 at least as early as Nov. 27, 2017.

* cited by examiner

SHORING END SECTION ASSEMBLY AND METHOD OF USE

TECHNICAL FIELD

This disclosure relates generally to end sections for shoring equipment that allow connections to spreaders and, more specifically, end section design features for safety, increased strength, improved longevity, and ease of use. The features disclosed herein are numerous in nature and may be utilized in a number of different ways to provide the same or similar shoring end section assembly results.

RELATED ART

Shoring systems are used in many applications to increase safety in trenching excavations at construction sites and during maintenance and repair work. Many construction/maintenance projects require personnel to enter into the excavation trenches to work on underground pipes, electrical and communication lines, etc. Excavation trenches can be rather deep or through unstable soil. Cave-ins of the excavation trenches not only interfere with the maintenance or construction operations, but may cause serious injury, or even loss of life to working personnel. The risk is so significant that the Occupational Health and Safety administration generally requires shoring equipment be used whenever the trench is five feet deep or greater. Many various types of prior art devices are utilized in these maintenance and construction trenching or excavation shoring operations, such as shoring boxes, shields, frames, etc.

Many shoring systems are characterized by the use of walls or panels with spreader beams spanning the excavation between the panels. The panels often have nipples connected to the panels to hold the spreader bars. Over time, the stress at the nipple connectors experienced due to the spreader beams causes the nipple connectors to bend or break. This can cause dangerous conditions for workers and also be difficult and expensive to repair (if repair is possible). If repair is not possible, the entire panel with the broken nipple must be disposed of.

While the prior art nipple-couplings provide a connection for spreader beams needed in shoring equipment, they generally do not provide the additional support needed for structural integrity. The shoring end section assembly disclosed herein takes into account the stress and wear placed on the tubular couplings connected to spreader bars and reinforces the couplings to provide better wear over time and make them easier to repair.

SUMMARY

This disclosure, in at least one aspect, relates to a new design for a shoring end section. According to one aspect, the end section includes a through-wall tube and at least one through-wall tubular coupling assembly passing through the through-wall tube to provide additional stability to the tubular coupling assembly.

According to another aspect, the tubular coupling assembly may be sized to receive the distal end of a spreader beam for a shoring box, etc. The through-wall tubular coupling may have a proximal end and a distal end, and in some configurations, a spreader stop may be provided. The spreader stop may be disposed within the distal end of the tubular coupling.

In some configurations, a through-wall collar may be provided. The through-wall collar may be sandwiched between the distal end of the through-wall tubular coupling and the through-wall tube. A tubular coupling collar may also be provided and disposed around the proximal end of the through-wall tubular coupling.

In some configurations it may be desirable to provide one or more holes for receiving pins to secure a spreader beam within the tubular coupling. The tubular coupling may be provided with two holes on opposing sides for receiving a pin to retain a spreader. The tubular coupling may also be provided with washer plates disposed over such holes to provide stability and decrease the wear around such holes.

In some configurations, one or more through-wall tubular coupling assemblies may be provided on each shoring end section. The coupling assemblies may be connected via a transverse rigidifying member.

According to one aspect, an angle brace may be provided connecting a coupling assembly to the through-wall tube. The angle brace may be a notched angle brace for fitting over the through-wall collar. Where there is no through-wall collar used, the angle brace may not be provided with a notch. The angle brace may further include a wear bar on the proximal face.

There is a plurality of means and methods for forming the shoring end section and multiple variations are disclosed herein. Other aspects, as well as features and advantages of various aspects of the disclosed subject matter will become apparent to one of ordinary skill in the art from the ensuing description, the accompanying drawings and the appended claims.

Figure 1:
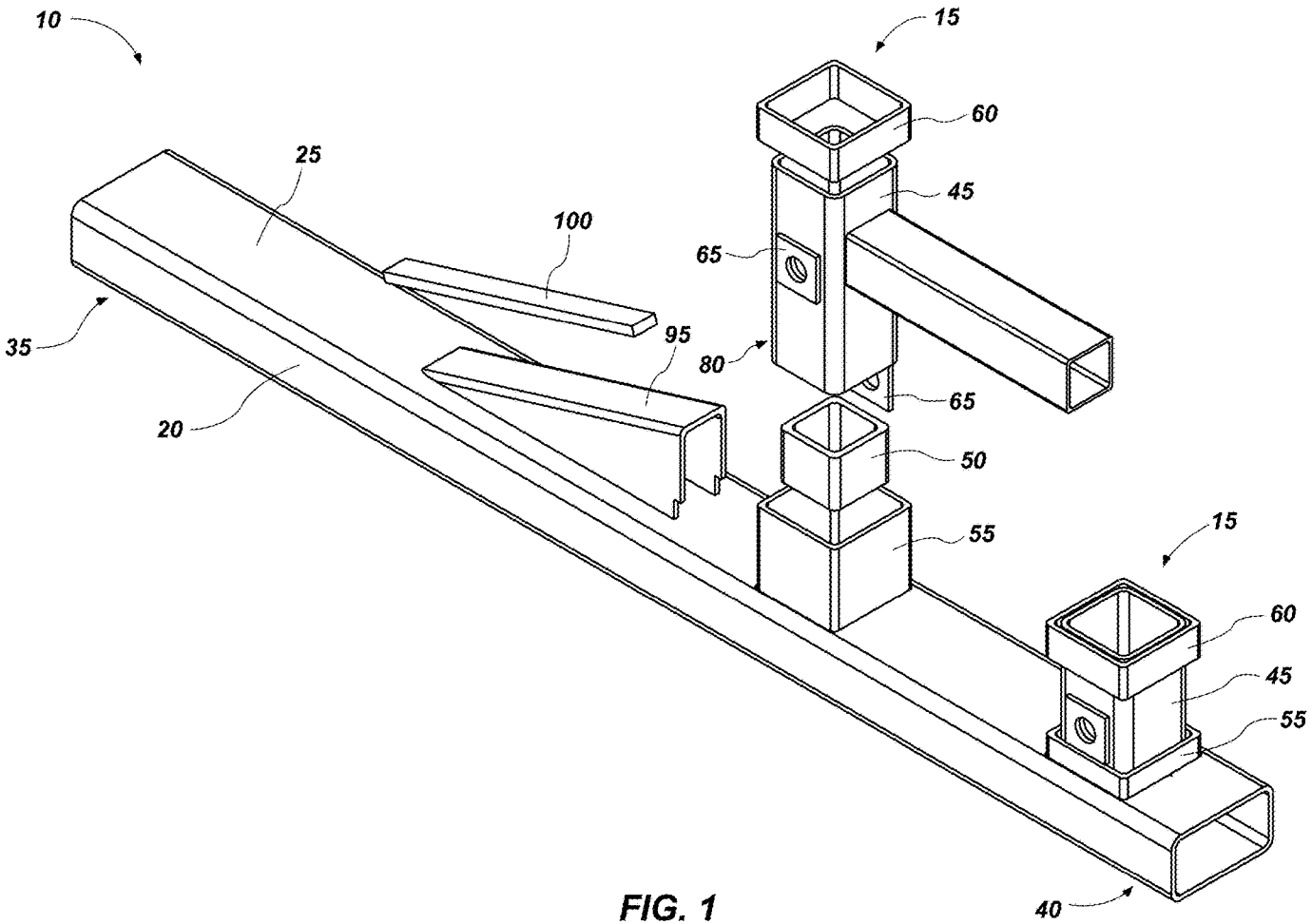
FIG. 1 shows a partially exploded view of a shoring end section assembly in accordance with the teachings of the present disclosure.
Figure 2:
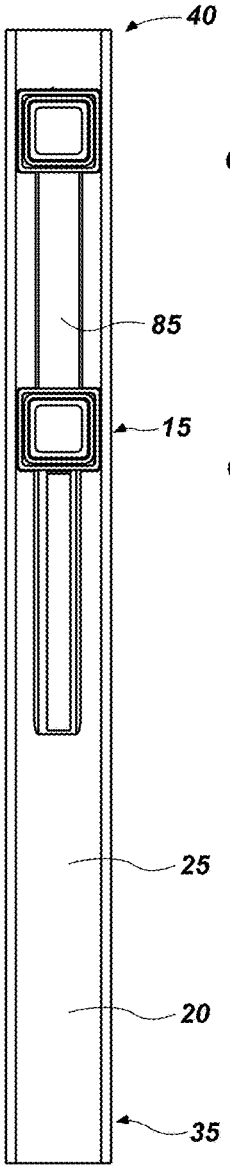
FIG. 2 shows a front view of the shoring end section assembly of FIG. 1 viewed from the inside or proximal side.
Figure 3:
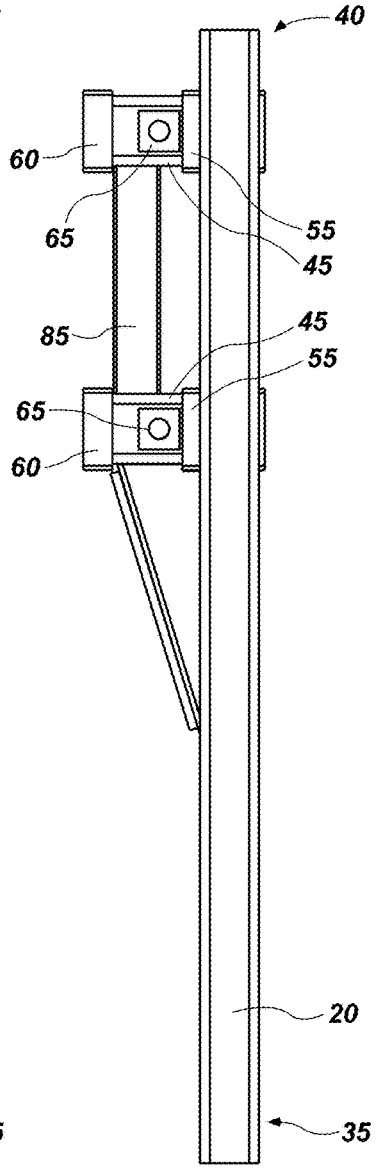
FIG. 3 shows a side view of the shoring end section assembly of FIG. 2.
Figure 4:
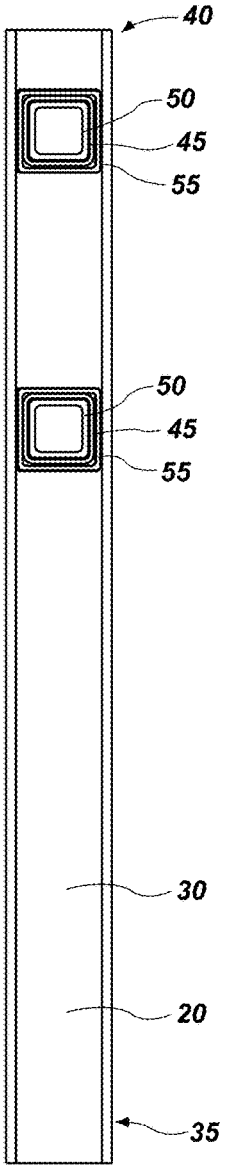
FIG. 4 shows a rear view of the shoring end section assembly of FIG. 2 viewed from the outside or distal side.
Figure 5:
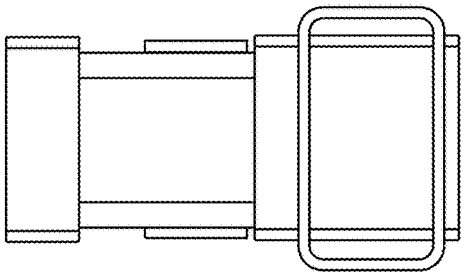
FIG. 5 shows a top view of the shoring end section assembly of FIG. 2 viewed from the top side.
Figure 7:
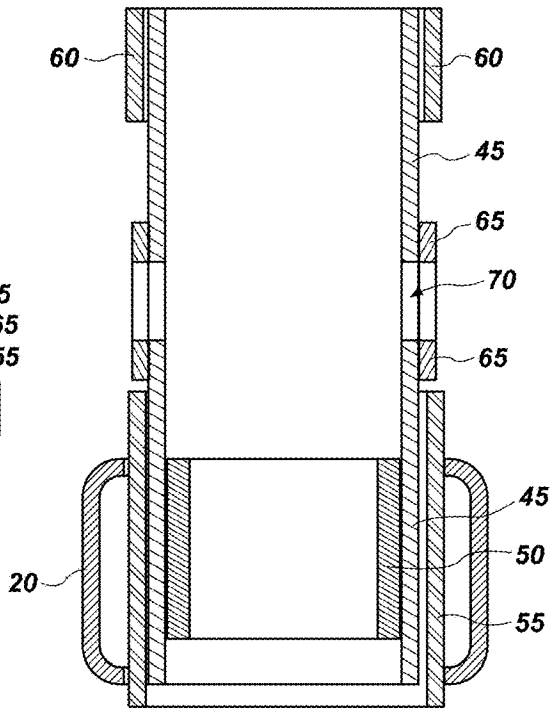
FIG. 7 shows a cross-sectional view of shoring end section assembly taken along line 7-7 of FIG. 6.

It will be appreciated that the drawings are illustrative and not limiting of the scope of the invention which is defined by the appended claims. The embodiments shown accomplish various aspects and objects of the invention. It will be appreciated that it may not be possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein. Likewise, it is not required that any feature in one embodiment be included in the invention as described by the claims unless that feature is expressly mentioned in the claims.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

As used in this specification and the appended claims, singular forms such as "a," "an," and "the" may include the plural unless the context clearly dictates otherwise. Thus, for example, reference to "a spring" may include an embodiment having one or more of such springs, and reference to "the layer" may include reference to one or more of such layers.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially hollow" would either be completely hollow or so nearly completely hollow that the effect would be effectively the same as if it were completely hollow.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

As used herein, "inside" or "proximal" means the side of the device which would face a user or worker located within the protective structure formed, such as a worker inside a trench shoring box. "Outside" or "distal" means the side of the device which would face the ground in which the protective structure may be placed. "Top" means the upper part of the device that would be highest in position when the protective structure is placed in the ground, and "bottom" means the lower portion of the device that would be in lowest position when the protective structure is placed in the ground.

Turning now to FIG. 1, there is shown a partially exploded view of a shoring end section assembly, generally indicated at 10, made in accordance with principles of the present disclosure. The end section assembly 10 may include one or more through-wall tubular coupling assemblies 15 disposed in or through a through-wall tube 20. In the configuration shown in FIG. 1, two tubular coupling assemblies 15 are shown. The through-wall tube may be generally hollow, and in some configurations has a generally square or generally rectangular shape. The through-wall tube 20 may have an inward or proximally facing side 25 (visible in FIG. 1) and an outer or distal side 30 (not visible in FIG. 1). The through-wall tube 20 may also have a bottom end 35 and a top end 40. The tubular coupling assemblies may be generally disposed at or toward the top end 40 of the through-wall tube 20. The through-wall tube 20 may be formed from a single tube, or may be formed by joining two or more tubes together. The length of the through-wall tube may be configured to be any length desired, and in some configurations may be around 246.38 centimeters (97 inches). Shorter and/or taller through-wall tubes may be used depending on the particular needs of the excavation. Similarly, one or more tubular coupling assemblies depending on the particular needs of the individual excavation and the number of spreader beams required.

Figure 9:
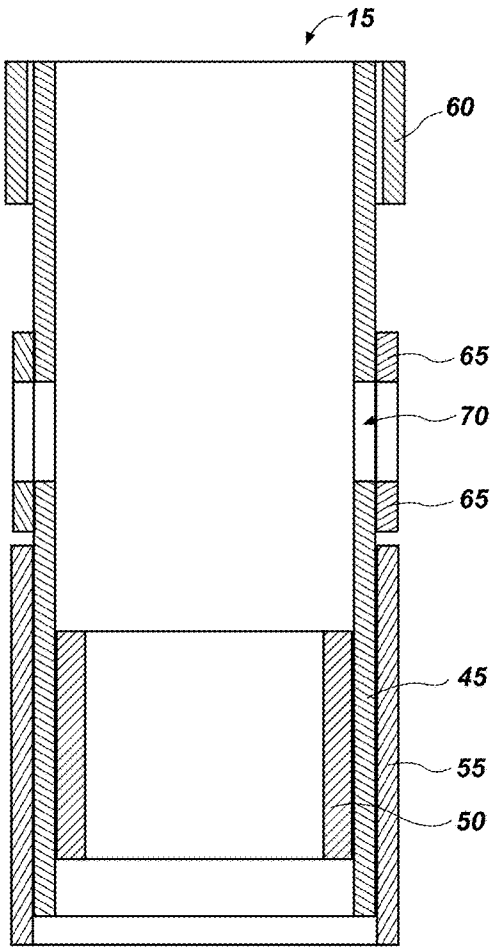
FIG. 9 shows a cross sectional view of the through-wall coupling assembly of FIG. 8 taken along line 9-9 of FIG. 8.
Figure 8:
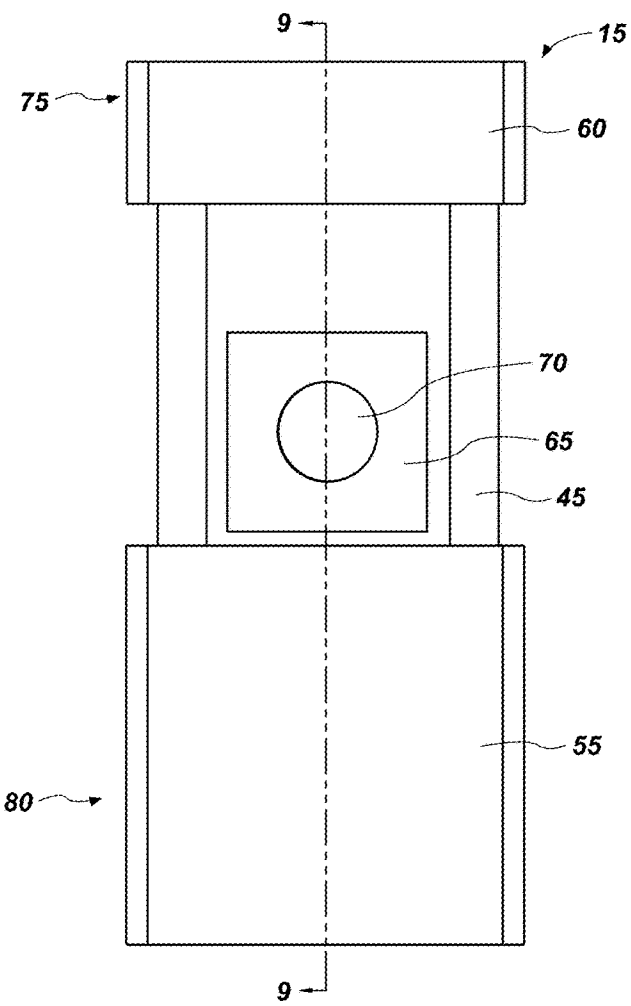
FIG. 8 shows a side view of a through-wall coupling assembly.

The through-wall tubular coupling assemblies 15 may be comprised of one or more of the following: a through-wall tubular coupling 45, a spreader stop 50, a through-wall collar 55, a tubular coupling collar 60, and one or more washer plates 65. Each element is described in detail below. FIG. 8 shows a side view of a coupling assembly 15, and FIG. 9 shows a cross-sectional view taken along line 9-9 of FIG. 8. The components of the tubular coupling assemblies may be welded together, and the entire coupling assembly may be welded to the through-wall tube 20 by welding the through-wall collar 55 to the proximal side 25 and distal side 30 of the through-wall tube 20. For example, the spreader stop 50 may be welded to the inside, distal end of the through-wall tubular coupling 45, with the through-wall collar 55 welded to the outside, distal end of the through-wall tubular coupling 45. Similarly, washers 65 may be welded to the exterior of the tubular coupling 45, and tubular coupling collar 60 may be welded to the exterior proximal end of the tubular coupling 45.

As shown in FIG. 1, the through-wall tubular coupling 45 may be any general shape and size to receive a distal end of a spreader beam. In some configurations, the through-wall tubular coupling 45 may be generally square in cross section to make it easier to repair. The through-wall tubular coupling 45 may extend through the through-wall tube 20. The through-wall tube 20 may be provided with one or more cut-outs extending through the proximal side 25 and distal side 30 (distal side not visible in FIG. 1). The through-wall tubular coupling 45 may extend through the through-wall tube via this cut-out, and be welded to the through-wall tube directly, or may be provided with a through-wall collar 55 which is welded to the through-wall tube. Other suitable connection methods may also be used.

In some configurations, two cut-outs are provided in the through-wall tube 20 such that the tubular coupling assembly 15 extends through both sides of the through-wall tube 20. This increases the weldable area by extending the components of the coupling assembly through the distal side 30 of the through-wall tube 20. This configuration may also provide better dispersion of the torque applied to the coupling, i.e., it may better distribute the force between the proximal side 25 and the distal side 30 of the through-wall tube 20. The coupling assembly 15 may be welded in place at the proximal side 25 and the distal side 30 of the through-wall tube 20. In other configurations, a single cut-out on the proximal side 25 of the through-wall tube 20 may be provided, without the cut-out on the distal side 30. In this type of configuration, the coupling assembly 15 extends into the through-wall tube from cut-out in the proximal side 25, and abuts the interior of the distal side 30 of the through-wall tube 20. The coupling assembly may be welded into place at the proximal side, around the through-wall collar 55.

The through-wall tubular coupling 45 may extend past the proximal side 25 of through-wall tube. For example, the through-wall tubular coupling 45 may extend about 25.4 centimeters (10 inches) past the proximal side 25 of the through-wall tube 20 to allow space for connection to a spreader beam and/or pin. Other lengths may be appropriate and/or desirable depending on the uses for the tubular coupling 45.

Figure 11:
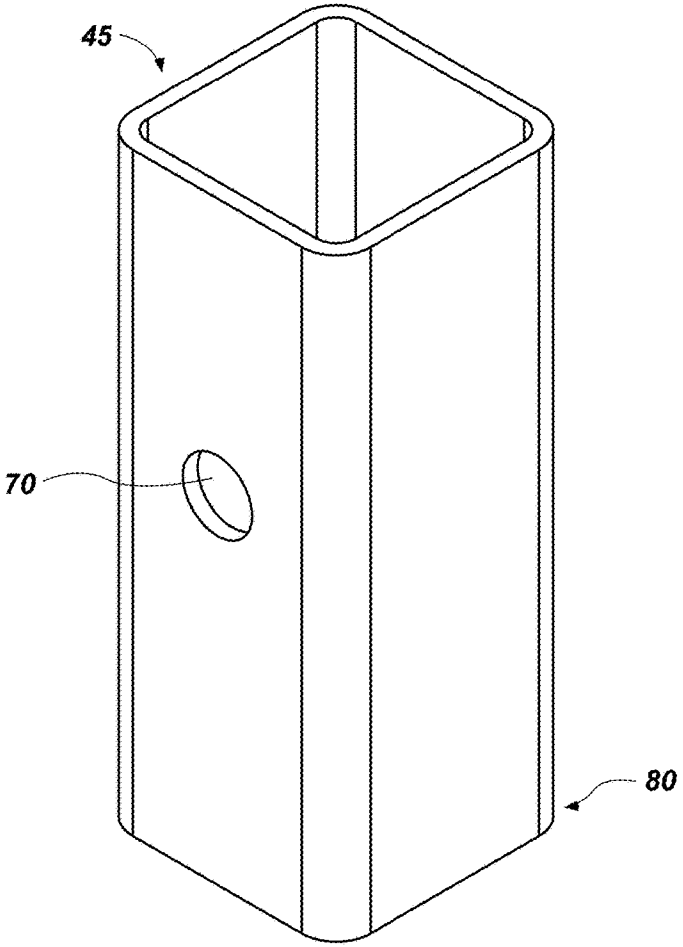
FIG. 11 shows a perspective view of the through-wall tubular coupling of FIG. 10.
Figure 10:
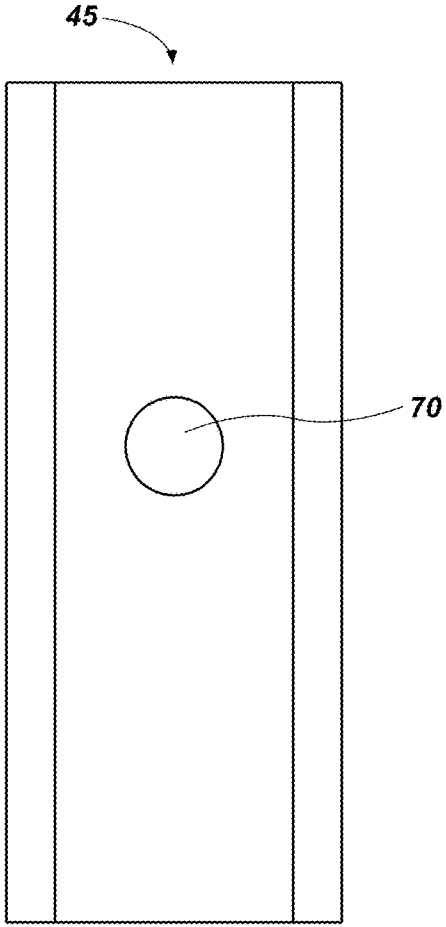
FIG. 10 shows a side view of a through-wall tubular coupling.

Referring briefly to FIG. 10, there is shown a side view of a tubular coupling, generally indicated at 45, and FIG. 11 shows a perspective view of the tubular coupling 45. The tubular coupling 45 may be provided with two holes 70 extending transversely across the coupling. These holes 70 may allow a pin to be inserted transversely through the tubular coupling. Depending on the spreader beam connection type, it may be desirable to insert the spreader beam into the proximal end 75 of the tubular coupling 45, and then insert a pin transversely through the holes 70.

Returning to FIG. 1, in some configurations, a spreader stop 50 may be provided. The spreader stop 50 may be disposed within the distal end of the through-wall tubular coupling 45 (and thus within the through-wall tube 20, as the distal end of the through-wall tubular coupling 45 is located in the through-wall tube 20). The spreader stop 50 may be welded to the interior, distal end of the through-wall tubular coupling 45. As spreader beams are inserted and removed from the proximal end of the through-wall tubular coupling 45, pressure may be exerted on the distal end of the tubular coupling 45. The spreader stop 50 may help in dispersing the pressure and decreasing inward bending/distortion of the distal end 80 of the tubular coupling 45 over time.

A through-wall collar 55 may be disposed between the distal end 80 of the through-wall tubular coupling 45 and the through-wall tube 20. The through-wall collar 55 may thus be sandwiched between the through-wall tube 20 and the tubular coupling 45. The through-wall collar 55 may provide additional support and rigidity to the distal end of the tubular coupling 45 as the distal end 80 of the coupling 45 experiences stress and pressure from spreader beams inserted and removed from the proximal end of the coupling 45. The through-wall collar 55 may be approximately sized to receive the tubular coupling 45. The through-wall collar 55 may pass through the through-wall tube 20 and extend proximally past the proximal side of the through-wall tube 20, for example, it may extend proximally around 3.81 centimeters (1.5 inches). The through-wall collar 55 may be welded on its exterior to the through-wall tube 20, and on its interior to the distal end of the coupling 45.

A second collar, a tubular coupling collar 60, may be disposed around the proximal end of the through-wall tubular coupling 45. The tubular coupling collar may be welded to the proximal end of the tubular coupling 45. This proximal coupling collar 60 may provide added strength and support to the proximal end of the tubular coupling 45 as spreader beams are inserted into and removed from the proximal end of the tubular coupling 45.

Figure 13:
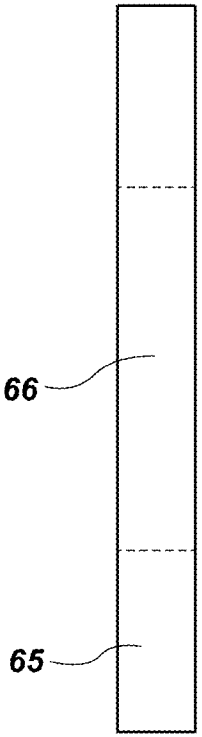
FIG. 13 shows a side view of the washer plate of FIG. 12.
Figure 12:
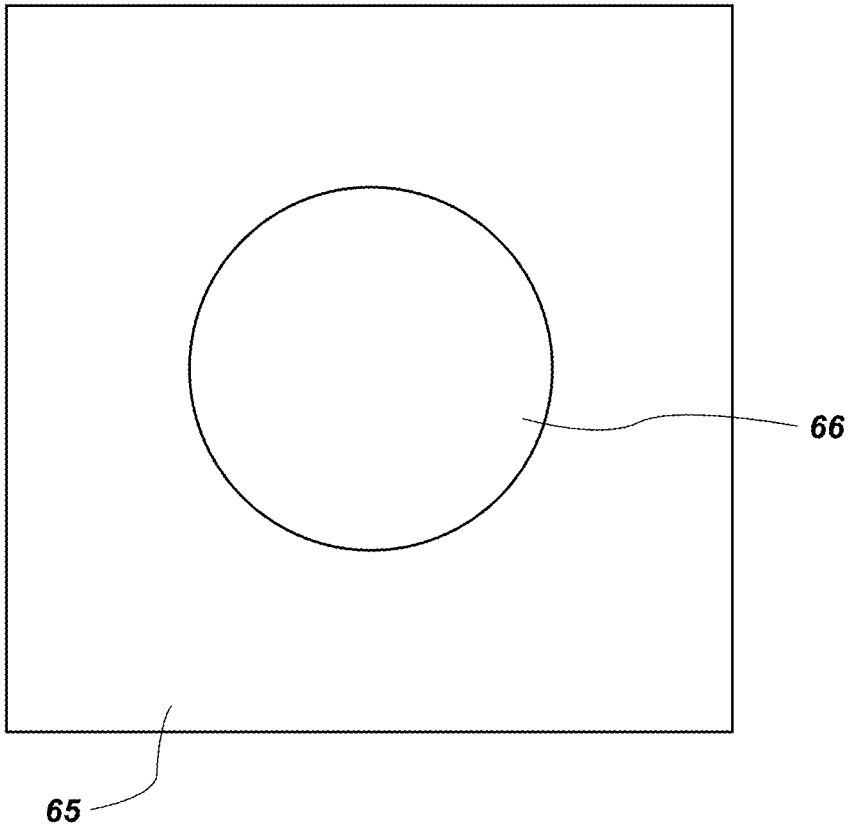
FIG. 12 shows a front view of a washer plate that may be used in some configurations according to the present disclosure.

FIG. 12 shows a front view of a washer plate 65 and FIG. 13 shows a side view of the washer plate of FIG. 12. One or more washer plates may be disposed on opposing outside walls of the through-wall tubular coupling 45. The washer plates 65 may be welded in place on opposing outside walls of the tubular coupling 45. Depending on the connection type of the spreader beam, the spreader beam may be provided with a pin to be inserted transversely through the tubular coupling 45 and spreader beam after the spreader beam is inserted into the proximal end of the tubular coupling. A washer plate with a hole 66 therethrough may be placed on each side of the tubular coupling such that the holes 70 of the tubular coupling 45 (FIG. 1) are in line with the holes of the washer plate. This may reduce the wear on the tubular coupling 45 as spreader beam pins are inserted and removed through the tubular coupling 45.

It will be appreciated that the components of the through-wall tubular coupling assembly 15 can be welded together along their interfaces, or any other suitable connection type may be used. The components of the coupling assembly 15 may be formed from any suitable material, for example, steel may be used, aluminum, other alloys, etc.

Figure 6:
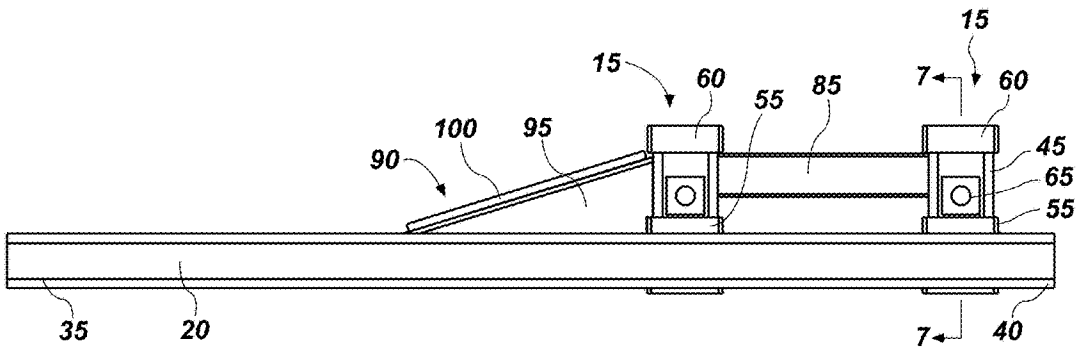
FIG. 6 shows a side view of the shoring end section assembly of FIG. 2 with line 7-7 identified.

One or more such through-wall tubular coupling assemblies may be provided on an end section assembly. In some configurations, two coupling assemblies 15 may be provided, with a transverse rigidifying member 85 connecting the first through-wall tubular coupling assembly and the second through-wall tubular coupling assembly as shown in FIG. 6. The transverse rigidifying member 85 may serve to provide added stability to the coupling assemblies, particularly the portions of the coupling assemblies that extend out of the through-wall tube 20. The transverse rigidifying member 85 may also serve to disperse force between the through-wall tubular coupling assemblies 15. The transverse rigidifying member 85 may be welded into place on the exterior of the proximal end of the through-wall tubular coupling 45, below the tubular coupling collar 60. The transverse rigidifying member 85 may be welded on one end to a first coupling assembly, and on the other end welded to a second coupling assembly to disperse the force between the couplings assemblies.

Figure 14:
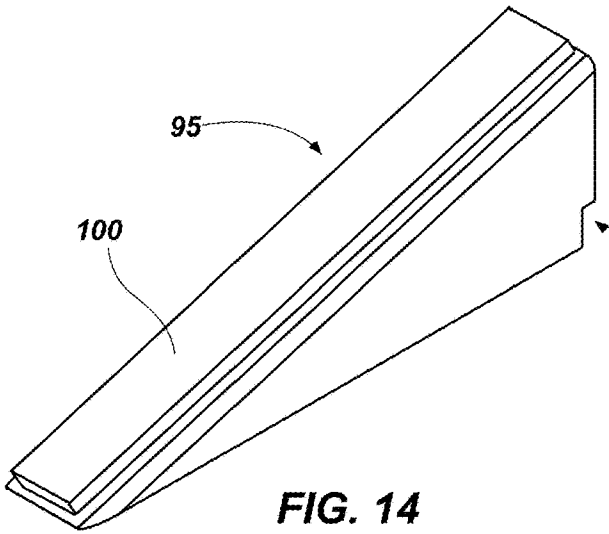
FIG. 14 shows a perspective view of a notched angle brace that may be used in some configurations according to the present disclosure.
Figure 15:
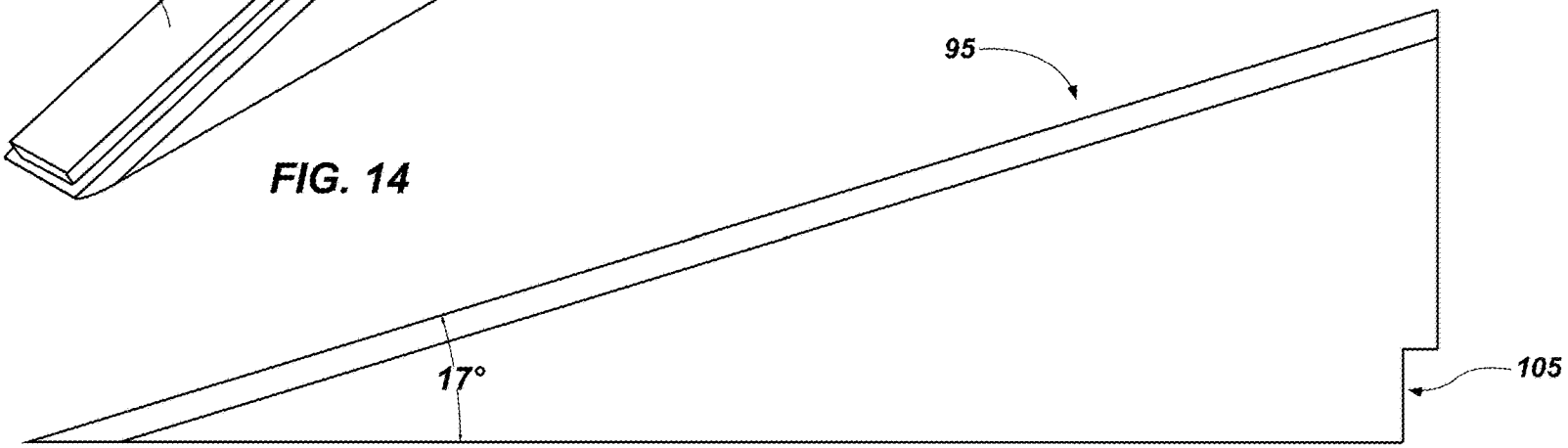
FIG. 15 shows a side view of the notched angle brace of FIG. 14.

In some configurations, the lowest tubular coupling assembly 15 (or the tubular coupling assembly 15 nearest the bottom end 35 of the through-wall tube 20) may be provided with a notched angle brace assembly 90 (FIG. 6). FIGS. 14 and 15 show perspective and side views, respectively of the notched angle brace generally indicated at 95. The angle brace assembly 90 may include an angle brace 95, and a wear bar 100. The angle brace 95 may have sidewalls having a cut-away or notch 105. The cut-away or notch 105 allows angle brace 95 to be closely received over the through-wall collar 55. The angle brace 95 may be welded to the through wall collar 55 at or near notch 105, and then welded to the side of the exterior of the tubular coupling 45 above notch 105. In configurations where no through-wall collar 55 is used, the angle brace 95 need not be provided with a notch, and may be directly welded to the side of the exterior of the tubular coupling 45.

The angle brace assembly 90 may be connected (for example, via welding) to the inside or proximal side 25 of the through-wall tube 20 and the bottom or lower through-wall tubular coupling assembly. The angle brace 95 extends at an angle of around 10 degrees to around 20 degrees away from the through-wall tube as it extends toward the tubular coupling assembly. The transverse rigidifying member 85 and angle brace 95 may provide additional rigidity to the through-wall coupling assemblies. In the prior art, if a force perpendicular to the coupling is applied, all of the force must be held by the coupling. In contrast, the present disclosure allows the force to be distributed between the one or more coupling assemblies through the transverse rigidifying member, between the coupling assemblies 15 and the through-wall tube 20 through the angle brace.

While the figures show the tubular coupling, spreader stop, collars, etc. as being generally square, it will be appreciated that they may be formed in any desired shape, including round, rectangular, triangular, etc.

In shoring applications, the end section assembly may be attached to a shoring frame, etc. Once the end section assembly and frame is in place, a spreader bar may be inserted into the proximal end of each of the through-wall tubular coupling assemblies 15. A pin may then be passed through a washer plate 65, the through-wall tubular coupling 45, and through a second washer plate 65 (see FIG. 1). It is common in prior art configurations for the couplings or nipples on trench shoring equipment to shear off due to the force applied at the couplings or nipples, rendering the apparatus unusable. Because the end section assembly 10 according to the present disclosure is provided with its own through-wall tube, and supported through-wall tubular coupling assemblies, wear on the couplings is greatly reduced and breakages decrease. Additionally, the present disclosure renders repairs, if needed, easier to perform.

EXEMPLARY IMPLEMENTATION

Various configurations of the shoring end section are possible depending on the specific needs of a particular excavation/work site. The following specific example is given by way of illustration and does not limit the claims to a particular embodiment.

In this example, the shoring end section assembly is utilized in conjunction with an 8-foot-series shoring box for disposition in a trench. The 8-foot-series box is about 2.49 meters (98 inches) tall. The end section assembly used in this example with an 8-foot series box has a length of about 2.46 meters (97 inches), or a length that is slightly smaller than the height of the trench shoring box. The slightly shorter length of the end section assembly allows protective caps, which have a thickness of about 0.3175 centimeters (⅜ inches), to be inset at the top and bottom of the end section panel. The protective caps may provide additional protection to the end section assemblies to extend the life of the end section assemblies.

Figure 16:
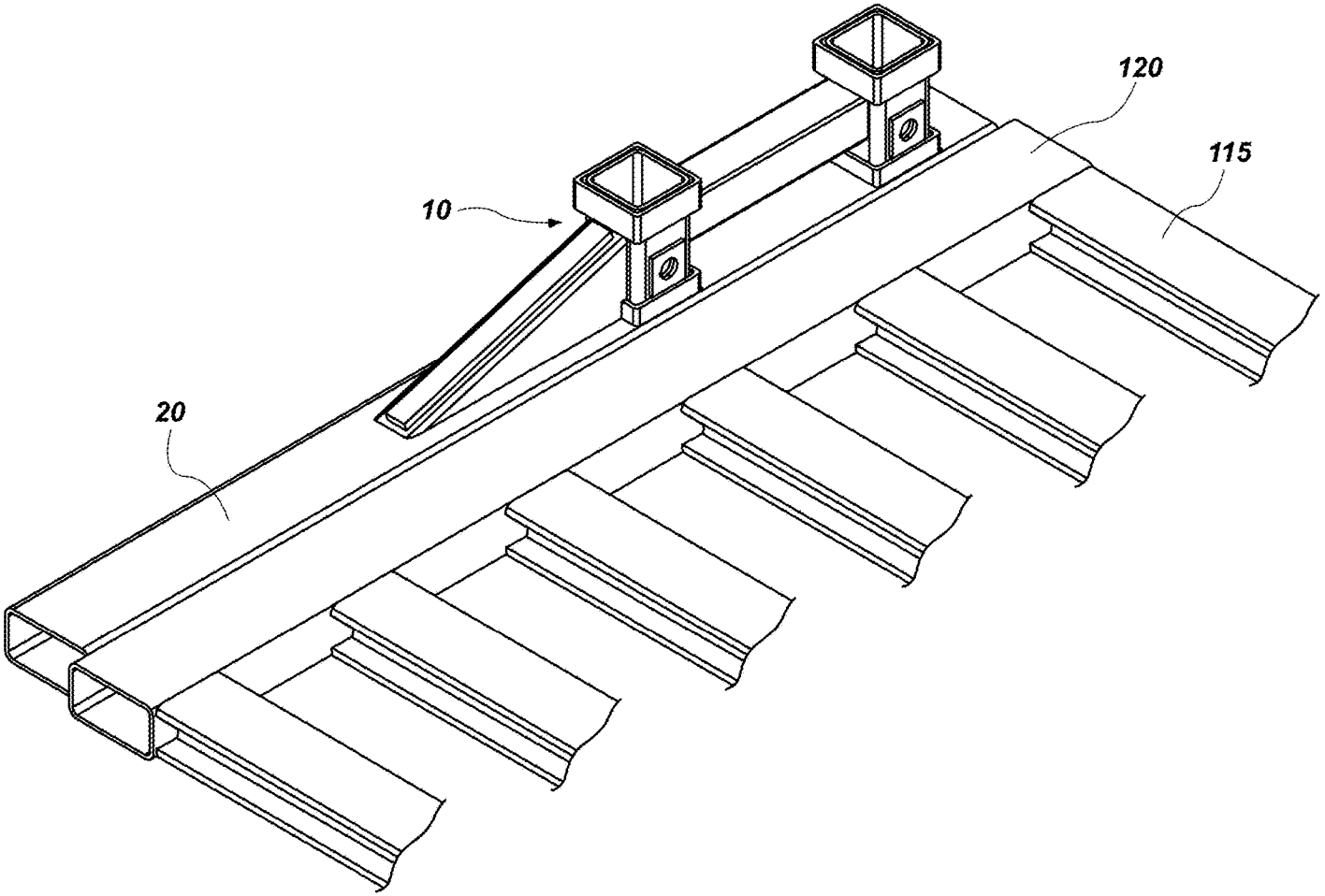
FIG. 16 shows a perspective view of a shoring end section assembly welded to a panel frame.

The end section assembly 10 connects to a panel frame (115 in FIG. 16) that may be specially configured to accept it. For example, the panel frame 115 may have an end tube 120 with a mating surface to weld the through-wall tube 20 of the shoring end section assembly 10 to the panel frame end tube 120. Connection of the end section assembly to a panel frame may be via other suitable methods known in the art, including, for example, welding.

The specifications of the parts in this specific example are given in Table I. In this configuration, two through-wall tubular coupling assemblies are attached to the through-wall tube. The through-wall tube has two holes cut in it to receive the two through-wall tubular coupling assemblies. The first hole is cut beginning at 5.125 inches from the first end 40 of the through-wall tube. Each hole is approximately 7.125 inches square with rounded corners each having a radius of 0.375 inches. The distance between the center of each hole, and thus the distance the two through-wall tubular coupling assemblies, is 25.5 inches.

TABLE I

| Part | Size Specifications | Material |
|---|---|---|
| Through-wall tube | TS 9 × 5 × ⅜ @ 97 inches | STEEL ASTM A500B |
| Through-wall collar | TS 7 × 7 × ⅜ @ 7 inches | STEEL ASTM A500B |
| Through-wall tubular coupling | 15 inches tall<br>3.5 inches wide<br>Center of hole for receiving bolt 8.5 inches from the bottom, 6.5 inches from the top, radius of hole 0.875 inches | STEEL ASTM A500B |
| Through-wall tubular coupling collar | TS 7 × 7 × ⅜ @ 2½ inches | STEEL ASTM A500B |
| Spreader Stop | TS 5 × 5 × ½ @ 4 inches | STEEL ASTM A500B |
| Washer plate | 3.5 inches tall<br>3.5 inches wide<br>0.375 inches thick<br>Radius of hole through center of washer plate 0.875 inches | STEEL ASTM A36 |
| Entire through-wall tubular coupling assembly | 15.5 inches tall | STEEL ASTM A36, STEEL ASTM A500B |
| Notched angle brace | Height of 7.1 inches<br>Length of 23.17 inches<br>Forming an angle of 17 degrees above through-wall tube<br>Notch 1.5 inches tall, 0.6 inches deep | STEEL ASTM A500B |
| Transverse rigidifying member | TS 4 × 4 × ¼ @ 19½ inches | STEEL ASTM A500B |
| Wear Bar | 22 inches long | Steel |

While the present disclosure shows various specific embodiments of the shoring end section assembly, it will be appreciated in light of the present disclosure that other configurations may be used in accordance with principle of the present invention. For example, the end section assembly may include a single tubular coupling assembly, two tubular coupling assemblies with a transverse rigidifying member extending therebetween, or three or more tubular coupling assemblies each with a transverse rigidifying member extending therebetween. Similarly, a notched angle brace may or may not be provided for one or more of the tubular coupling assemblies. Within the coupling assembly, the through-wall collar and tubular coupling collar and spreader stop may or may not be provided depending on the configuration. Where no through-wall collar is provided, the angle brace need not be notched. The specific examples given herein may also be used on different sized shoring boxes, for example, 6-foot and 4-foot type boxes. Thus it should be appreciated that the appended claims are not limited by the specific embodiments discussed herein.

It will be appreciated that the present disclosure covers multiple inventions which may be used together or separately. For example, a shoring end section assembly may include: at least one through-wall tube having a proximal side and a distal side, and at least one hole through the proximal side and distal side for receiving at least one through-wall tubular coupling assembly, the at least one through-wall tubular coupling assembly comprising: a through-wall tubular coupling sized to receive a distal end of a spreader beam, the through-wall tubular coupling extending through the through-wall tube from the proximal side to the distal side.

In some configurations, the at least one through-wall tubular coupling assembly further comprises a through-wall collar disposed between the through-wall tube and the through-wall tubular coupling. The at least one through-wall tubular coupling assembly may further comprise a spreader stop. The at least one through-wall tubular coupling assembly may have a proximal end and a distal end, and further comprise a tubular coupling collar disposed on the proximal end.

The through-wall tubular coupling may define a hole extending transversely through the through-wall tubular coupling for receiving a pin. The at least one through-wall tubular coupling assembly may further comprise at least one washer plate. In some configurations, the at least one washer plate comprises two washer plates disposed on opposing sides of the through-wall tubular coupling.

According to another configuration, the shoring end section assembly may further comprise an angle brace connected to the proximal side of the through-wall tube and at least one through-wall tubular coupling assembly. The angle brace may be connected to the proximal side of the through-wall tube and at least one through-wall tubular coupling assembly, and wherein the angle brace comprises a notch, and wherein the notch is disposed over the through-wall collar. A wear bar may be disposed on the proximal face of the angle brace.

A shoring end section assembly may comprise: a through-wall tube having an inside face and an outside face; a first and second through-wall tubular coupling assembly, each of the first and second through-wall tubular coupling assembly comprising: a through-wall tubular coupling sized to receive a distal end of a spreader beam, the through-wall tubular coupling extending through the through-wall tube from the outside face to the inside face, the through-wall tubular coupling having a proximal end and a distal end, a spreader stop disposed within the distal end of the through-wall tubular coupling; a through-wall collar disposed between the distal end of the through-wall tubular coupling and the through-wall tube; a tubular coupling collar disposed around the proximal end of the through-wall tubular coupling; and a first and second washer plate disposed on opposing sides of the through-wall tubular coupling; a transverse rigidifying member connecting the first through-wall tubular coupling assembly and the second through-wall tubular coupling assembly; and a notched angle brace assembly connected to the inside face of the through-wall tube and the second through-wall tubular coupling assembly.

The notched angle brace assembly may comprise an angle brace and a wear bar. The angle brace forms an angle of about 10 degrees to about 20 degrees above the through-wall tube.

A method for forming a protective structure may comprise: selecting a protective panel having the shoring end section assembly disclosed herein; selecting a spreader beam having a first end and a second end; and inserting the first end of the spreader beam into the proximal end of the through-wall tubular coupling assembly. The method may further comprise selecting a second protective panel having a shoring end section assembly according to claim 1, and inserting the second end of the spreader beam into the proximal end of the through-wall tubular coupling assembly of the second protective panel.

Thus there is disclosed an improved shoring end section assembly. Those of skill in the art will appreciate that numerous modifications may be made hereto without departing from the scope and spirit of the invention. The appended claims are intended to cover such modifications.

What is claimed is:

1. A shoring end section assembly comprising:

at least one through-wall tube having a proximal side and a distal side, the at least one through-wall tube defining a void, and wherein the at least one through-wall tube comprises a through-wall tube having a circular shape;

at least one hole extending through both the proximal side and distal side for receiving at least one through-wall tubular coupling assembly through the proximal side, void, and distal side;

the at least one through-wall tubular coupling assembly comprising:

a through-wall tubular coupling sized to receive a distal end of a spreader beam, the through-wall tubular coupling extending through the through-wall tube from the proximal side to the distal side.

2. A shoring end section assembly comprising:

at least one through-wall tube having a proximal side and a distal side, the at least one through-wall tube defining a void, wherein the at least one through-wall tube comprises a through-wall tube having a rectangular shape, at least one hole extending through both the proximal side and distal side for receiving at least one through-wall tubular coupling assembly through the proximal side, void, and distal side;

the at least one through-wall tubular coupling assembly comprising:

a through-wall tubular coupling sized to receive a distal end of a spreader beam, the through-wall tubular coupling extending through the through-wall tube from the proximal side to the distal side.

3. A method for forming a protective structure, the method comprising:

selecting a protective panel having a shoring end section assembly comprising at least one through-wall tube having a proximal side and a distal side, the at least one through-wall tube defining a void, at least one hole extending through both the proximal side and distal side for receiving at least one through-wall tubular coupling assembly through the proximal side, void, and distal side;

the at least one through-wall tubular coupling assembly comprising:

a through-wall tubular coupling sized to receive a distal end of a spreader beam, the through-wall tubular coupling extending through the through-wall tube from the proximal side to the distal side;

selecting a spreader beam having a first end and a second end; and inserting the first end of the spreader beam into the proximal end of the through-wall tubular coupling assembly.

4. The method according to claim 3, the method further comprising selecting a second protective panel having a shoring end section assembly comprising at least one through-wall tube having a proximal side and a distal side, the at least one through-wall tube defining a void, at least one hole extending through both the proximal side and distal side for receiving at least one through-wall tubular coupling assembly through the proximal side, void, and distal side;

the at least one through-wall tubular coupling assembly comprising:

a through-wall tubular coupling sized to receive a distal end of a spreader beam, the through-wall tubular coupling extending through the through-wall tube from the proximal side to the distal side, and inserting the second end of the spreader beam into the proximal end of the through-wall tubular coupling assembly of the second protective panel.

5. A method for forming a protective structure, the method comprising:

selecting a protective panel having an end portion;

selecting a shoring end section assembly comprising:

at least one through-wall tube having a proximal side and a distal side, the at least one through-wall tube defining a void, at least one hole extending through both the proximal side and distal side for receiving at least one through-wall tubular coupling assembly through the proximal side, void, and distal side;

the at least one through-wall tubular coupling assembly comprising a through-wall tubular coupling sized to receive a distal end of a spreader beam, the through-wall tubular coupling extending through the through-wall tube from the proximal side to the distal side;

connecting the through-wall tube of the shoring end section assembly to the end portion of the protective panel.

6. The method of claim 5, wherein the step of connecting the through-wall tube of the shoring end section assembly to the end portion of the protective panel comprises welding the through-wall tube of the shoring end section assembly to the end portion of the protective panel.

7. The method of claim 5, wherein the step of connecting the through-wall tube of the shoring end section assembly to the end portion of the protective panel comprises at least one of welding, soldering, brazing, and gluing the through-wall tube of the shoring end section assembly to the end portion of the protective panel.

8. The method of claim 5, wherein end portion of the protective panel comprises an end tube, and wherein the step of connecting the through-wall tube of the shoring end section assembly to the end portion of the protective panel comprises welding the through-wall tube of the shoring end section assembly to the end tube of the end portion of the protective panel.

9. The method of claim 8, wherein the end tube comprises a mating surface to weld the end tube to the through-wall tube of the shoring end section.

10. The method of claim 9, wherein the step of welding the through-wall tube of the shoring end section assembly to the end tube of the end portion of the protective panel comprises welding the mating surface of the end tube to the through-wall tube of the shoring end section.

11. The method according to claim 8, further comprising the step of connecting protective caps at a top and a bottom of the through-wall tube of the shoring end section assembly.

12. The method of claim 8, wherein the through-wall tube further comprises a first sidewall and a second sidewall extending between the proximal side and distal side, and wherein the step of welding the through-wall tube of the shoring end section assembly to the end tube of the end portion of the protective panel comprises welding one of the first sidewall and the second sidewall to the end portion of the protective panel.

13. The method of claim 12, wherein the end tube comprises a mating surface to weld the end tube to the through-wall tube of the shoring end section, and wherein the step of welding one of the first sidewall and the second sidewall to the end portion of the protective panel comprises welding one of the first sidewall and the second sidewall to the mating surface of the end tube.

14. The method of claim 5, wherein the shoring end section assembly has a first length and wherein the protective panel has a second length, and wherein the first length is less than the second length.

15. The method of claim 5, wherein the through-wall tube further comprises a first sidewall and a second sidewall extending between the proximal side and distal side, and wherein the step of connecting the through-wall tube of the shoring end section assembly to the end portion of the protective panel comprises connecting one of the first sidewall and the second sidewall to the end portion of the protective panel.

* * * * *